US006148484A

United States Patent [19]

Andreae, Jr.

[11] Patent Number: 6,148,484

[45] Date of Patent: Nov. 21, 2000

[54] CLIP FOR RETAINING A GOLF SCORE CARD, AND OPTIONALLY PROVIDING ADVERTISEMENT, IN PASSENGER-CARRYING GOLF CARTS

[76] Inventor: Fred N. Andreae, Jr., 5232 S. Locustwood Dr., Fort Gratiot, Mich. 48059

[21] Appl. No.: 09/394,549

[22] Filed: Sep. 13, 1999

Related U.S. Application Data

[60] Provisional application No. 60/100,348, Sep. 15, 1998.

[51] Int. Cl.[7] ..... A63B 71/00

[52] U.S. Cl. ..... 24/3.11; 24/334; 24/306; 24/3.12

[58] Field of Search ..... 24/3.1, 3.11, 3.12, 24/306, 334, 457, 499, 500, 509, 510, 489, 67.11; 40/647, 658; 248/324, 317, 451, 442.2

[56] References Cited

U.S. PATENT DOCUMENTS

| | | | |
|---|---|---|---|
| 2,312,563 | 6/1943 | Penley | 24/334 |
| 3,374,508 | 3/1968 | Slimovitz | 24/3.1 |
| 3,453,696 | 7/1969 | Mates | 24/306 |
| 3,638,284 | 2/1972 | Baker | 24/306 |
| 4,158,906 | 6/1979 | Waton | 24/3.12 |
| 5,318,292 | 6/1994 | De Marco | 24/499 X |
| 5,640,742 | 6/1997 | White et al. | 24/3.12 |
| 5,975,390 | 11/1999 | Saroli | 224/274 |

OTHER PUBLICATIONS

Front and side views, prior art magnetic spring clip, *Ante* Sep. 15, 1997.

*Primary Examiner*—James R. Brittain
*Assistant Examiner*—Robert J. Sandy
*Attorney, Agent, or Firm*—Christopher John Rudy

[57] ABSTRACT

Clip has first and second elongate members, each with first and second opposing ends. The first ends of the members are in general registry, and the second ends of the members are in general registry. A pivoting spring connects the members under tension such that the members generally remain in a closed position with respect to each of their first ends and open with respect to each of their second ends. The members can be moved relative the pivoting spring such that the first ends are drawn open and the second ends are drawn to a more closed position. The first member has an attaching material thereon such that the clip can be attached to a suitable solid surface. In one case, the attaching material is non-magnetic. It may, however, be reversibly attaching, for an illustrative example, being part of a hook-and-loop material. The clip may contain advertisement or other indicia thereon. The clip may be attached to a passenger-carrying golf cart, and a golf score card can be protected from rain by providing the clip; attaching the clip to the underside of the passenger-carrying golf cart roof; and inserting the card into the clip for securing the card.

20 Claims, 1 Drawing Sheet

CLIP FOR RETAINING A GOLF SCORE CARD, AND OPTIONALLY PROVIDING ADVERTISEMENT, IN PASSENGER-CARRYING GOLF CARTS

CROSS-REFERENCE CLAIM OF PRIORITY

This claims benefit of U.S. provisional patent application No. 60/100,348 filed on Sep. 15, 1998. The specification of that application is incorporated herein by reference.

FIELD AND PURVIEW OF THE INVENTION

The present invention concerns a clip useful for retaining, among other things, a golf score card, and optionally providing advertisement, in passenger-carrying golf carts. The invention can concern the golf cart with the clip attached thereto, and a method of protecting the score card from rain.

BACKGROUND TO THE INVENTION

Passenger-carrying golf carts are a popular item on many golf courses. They provide for increased mobility, and a haven from the elements. Unfortunately, when, for example, it may rain, one drawback of the standard passenger-carrying golf cart is that the placement of the clips to hold the score cards on the steering wheel becomes noticeable in that the score cards become subject to substantial contact with the rain, and become wet. When play resumes, score is then taken with difficulty on the wet card.

It would be desirable to ameliorate or overcome such a drawback. It would be further desirable to not only do so, but also to provide further utility with respect to the same.

SUMMARY OF THE INVENTION

The present invention provides, in one aspect, a clip useful for retaining, among other things, a golf score card in a passenger-carrying golf cart, said clip comprising first and second elongate members, each having first and second opposing ends, said first ends of said members being in general registry, and said second ends of said members being in general registry; and a pivoting spring connecting said first and second members under tension such that said first and second members generally remain in a closed position with respect to each of their first ends and open with respect to each of their second ends, and said first and second members can be moved relative said pivoting spring such that said first ends are drawn open and said second ends are drawn to a more closed position; wherein said first member has an attaching material thereon such that said clip can be attached to a suitable solid surface. The clip may contain advertisement or other indicia thereon. The invention further provides a passenger-carrying golf cart with the clip attached thereto, and a method of protecting a golf score card from rain comprising providing a clip as aforesaid; attaching said clip to the underside of a passenger-carrying golf cart roof; and inserting said card into said clip for securing the card thereat.

The invention is useful in enhancing the game of golf, and it can be useful in advertising.

Significantly, by the invention, the drawback in heretofore known golf carts with respect to allowing score cards to get wet is ameliorated if not overcome. Furthermore, additionally useful advertising capability is provided with respect to the same. The invention is simple, effective, and pleasing to use.

DRAWINGS IN BRIEF

The drawings form part of the specification hereof. With respect to the drawings, the following is briefly noted:

ILLUSTRATIVE DETAIL OF THE INVENTION

Figure 1:
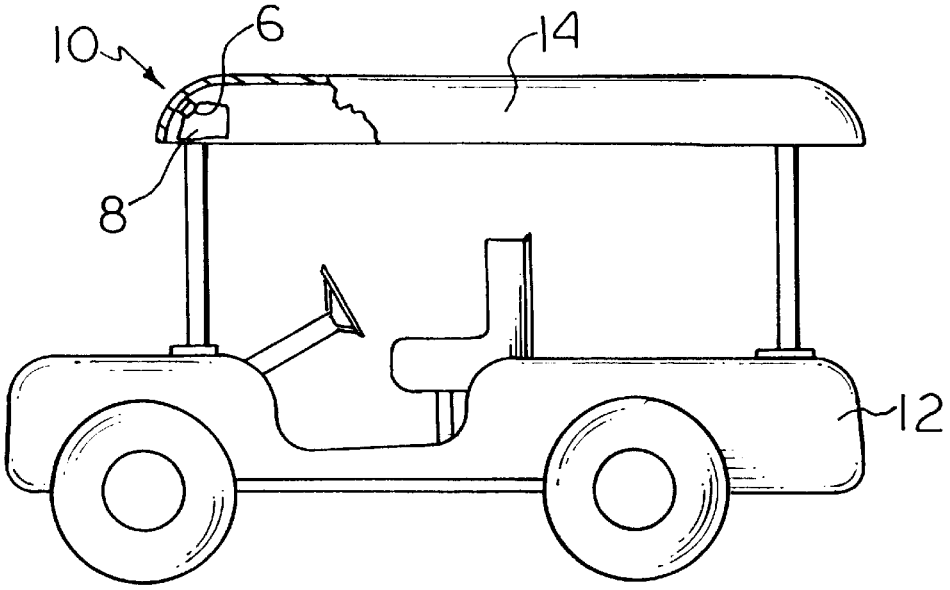
FIG. 1 is a side plan, partial cut-away, view of a preferred embodiment of the invention having its clip reversibly attached to an inside part of the roof of a passenger-carrying golf cart, and carrying a golf score card to be protected from the elements.
Figure 2:
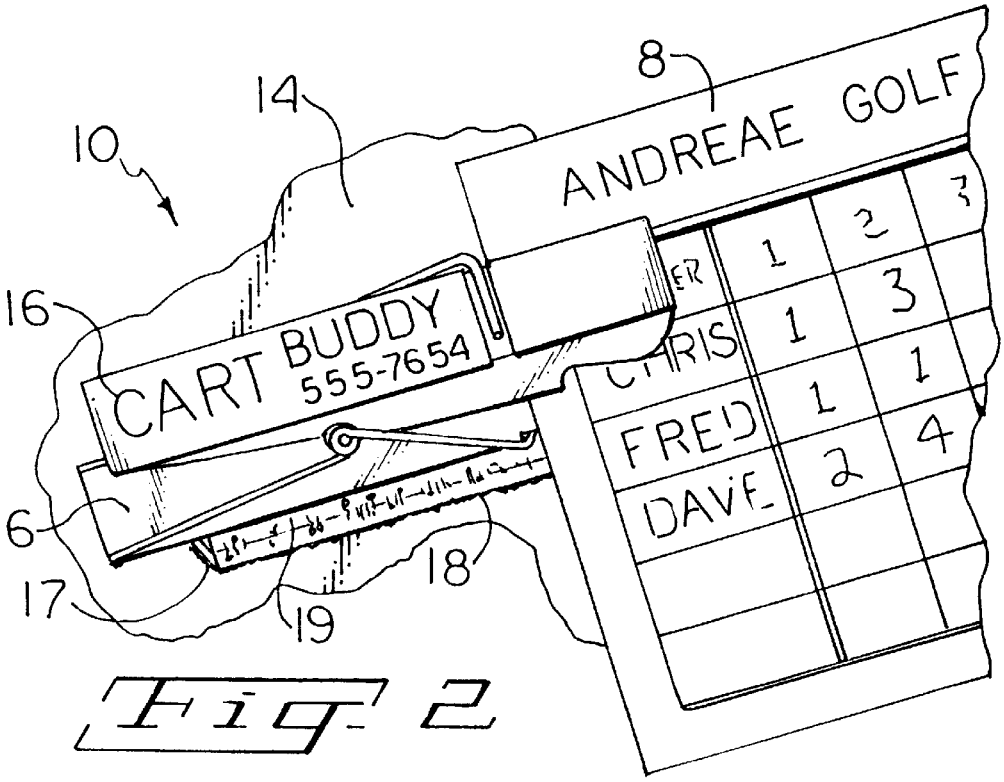
FIG. 2 is a close up view, looking upward, about the clip portion of the embodiment of FIG. 1.

The invention can be further understood by the present detail which may be read in view of the drawings. The same is to be taken in an illustrative and not necessarily limiting sense.

With respect to the drawings, the present invention 10 includes spring-loaded, pivoting clip 6, which can hold golf score card 8, and which may be attached to passenger-carrying golf cart 12 on the underside of its roof 14. As previously summarized, it can be seen that the clip 6 may take the form of a spring-loaded clothespin type device, and so forth and the like. One of the clip members, say, the first, has an attaching material thereon so that the clip 6 may be attached to the suitable solid surface, beneficially the underside cart roof 14 so that indicia 16 such as advertising may be provided on the external surface of the second member and be visible to a golfer during play, especially when he looks up at his score card 8 during periods of rain. Alternatively, an extended surface may be provided on the second or another surface for the display of the indicia 16. The attaching material may be provided directly on the first member, directly on the suitable surface to which the clip may be attached, or on both. The attaching material may comprise glue, staples, rivets, screws, dove-tails, magnets, and so forth and the like. Beneficially, the attaching material is a reversibly attaching material, which has advantages, among other things, of being able to alternate or substitute advertising messages, and to readily replace worn out or broken clips. Preferably, the attaching material comprises a hook-and-loop material such as well known VELCRO (Reg. U.S. Pat. & Tm. Off.) two piece, hook-and-loop material, one piece of which 17 is fastened by an adhesive 18 to the cart roof 14, the other piece of which 19 is fastened to the first member of the clip 6. See, e.g., De Mestral, U.S. Pat. Nos. 2,717,437 and 3,009,235. Such hook-and-loop material is commercially available with adhesive tape on its back, for example, from the 3M Co., St. Paul, Minn., and can be employed to advantage in view of its ready attachment and the fact that many passenger-carrying golf carts have non-ferrous roofs eliminating the option of magnetic attachment.

The clip of the invention has been favorably field tested. In several instances, the clip having one VELCRO hook-and-loop part was attached under the roof of a passenger-carrying golf cart having the other VELCRO hook-and-loop part. The golf cart operators reported favorably.

Numerous further advantages attend the invention.

For example, the clip can hold golf gloves, hats, tees, scorecards, etc., i.e., paraphernalia.

As well, the clip may be employed for attachment to an automobile dashboard or glovebox, a wall at home or in the garage, or any other suitable surface. Thus, calendars, maps, messages, and so forth, can be secured to a convenient spot, and the site can be kept neat. In the case of the automobile, safety may be improved as instead of storing papers above the visor, where the papers may be indavertently spilled when the visor is used as a sun shield, the papers are consolidated in a better place. Also, internal reflection from light colored papers otherwise scattered across the dashboard in front of the windshield may be ameliorated if not eliminated by consolidation.

CONCLUSION

The present invention is thus provided. Various features, parts, subcombinations and combinations of the invention can be practiced with or without reference to other features, parts, subcombinations or combinations, and numerous adaptations can be effected within the spirit of the invention, the literal claim scope of which is particularly pointed out as follows:

I claim:

1. A clip useful for retaining golf paraphernalia in a passenger-carrying golf cart, said clip comprising first and second elongate members, each having first and second opposing ends, said first ends of said members in general adjacently opposing each other, and said second ends of said members in general adjacently opposing each other; and a pivoting spring connecting said first and second members under tension such that said first and second members generally remain in a closed position with respect to each of their first ends and open with respect to each of their second ends, and said first and second members can be moved relative said pivoting spring such that said first ends are drawn open and said second ends are drawn to a more closed position; wherein said first member has a non-magnetic attaching material entirely attached to said first member and between said first and second opposing ends of said first member such that said clip can be attached to a suitable solid surface.

2. The clip of claim 1, wherein the attaching material is a reversibly attaching material.

3. The clip of claim 2, wherein the attaching material includes at least one component of a hook-and-loop material.

4. The clip of claim 3, which contains advertisement indicia thereon.

5. The clip of claim 2, which contains advertisement indicia thereon.

6. The clip of claim 1, which contains advertisement indicia thereon.

7. In combination:

a clip useful for retaining golf paraphernalia in a passenger-carrying golf cart, said clip comprising first and second elongate members, each having first and second opposing ends, said first ends of said members in general adjacently opposing each other, and said second ends of said members in general adjacently opposing each other; and a pivoting spring connecting said first and second members under tension such that said first and second members generally remain in a closed position with respect to each of their first ends and open with respect to each of their second ends, and said first and second members can be moved relative said pivoting spring such that said first ends are drawn open and said second ends are drawn to a more closed position; wherein said first member has an attaching material thereon; and a passenger-carrying golf cart to which the clip is attached.

8. The combination of claim 7, wherein the attaching material is non-magnetic.

9. The combination of claim 8, wherein the attaching material is a reversibly attaching material.

10. The combination of claim 9, wherein the attaching material includes at least one component of a hook-and-loop material on said first member, and a complementary component of the hook-and-loop material is on said cart.

11. The combination of claim 10, wherein the clip contains advertisement indicia thereon.

12. The combination of claim 9, wherein the clip contains advertisement indicia thereon.

13. The combination of claim 8, wherein the clip contains advertisement indicia thereon.

14. A method of protecting golf paraphernalia from rain comprising:

providing a clip useful for retaining golf paraphernalia in a passenger-carrying golf cart, said clip comprising first and second elongate members, each having first and second opposing ends, said first ends of said members in general adjacently opposing each other, and said second ends of said members in general adjacently opposing each other; and a pivoting spring connecting said first and second members under tension such that said first and second members generally remain in a closed position with respect to each of their first ends and open with respect to each of their second ends, and said first and second members can be moved relative said pivoting spring such that said first ends are drawn open and said second ends are drawn to a more closed position; wherein said first member has an attaching material thereon;

attaching said clip to the underside of a passenger-carrying golf cart roof; and inserting said card into said clip to secure said paraphernalia thereat.

15. The method of claims 14, wherein said paraphernalia includes a golf score card.

16. The method of claim 14, wherein the attaching is carried out through employment of a reversibly attaching material.

17. The method of claim 16, wherein the attaching is carried out through employment of hook-and-loop material.

18. The method of claim 16, wherein the clip contains advertising indicia thereon so as to provide advertisement.

19. The method of claim 17, wherein the clip contains advertising indicia thereon so as to provide advertisement.

20. The method of claim 14, wherein the clip contains advertising indicia thereon so as to provide advertisement.

* * * * *